US008011350B2

(12) United States Patent
Oono

(10) Patent No.: US 8,011,350 B2
(45) Date of Patent: Sep. 6, 2011

(54) HIGH PRESSURE FUEL PUMP CONTROL APPARATUS FOR AN INTERNAL COMBUSTION ENGINE

(75) Inventor: Takahiko Oono, Hyogo (JP)

(73) Assignee: Mitsubishi Electric Corporation, Tokyo (JP)

( * ) Notice: Subject to any disclaimer, the term of this patent is extended or adjusted under 35 U.S.C. 154(b) by 804 days.

(21) Appl. No.: 11/966,514

(22) Filed: Dec. 28, 2007

(65) Prior Publication Data

US 2008/0216797 A1 Sep. 11, 2008

(30) Foreign Application Priority Data

Mar. 9, 2007 (JP) ..... 2007-060009

(51) Int. Cl.
*F02D 1/00* (2006.01)
*F02M 37/04* (2006.01)

(52) U.S. Cl. ..... 123/447; 123/497; 123/506

(58) Field of Classification Search ..... 123/446, 123/447, 457, 458, 452, 456, 496, 497, 506
See application file for complete search history.

(56) References Cited

U.S. PATENT DOCUMENTS

| | | | | |
|---|---|---|---|---|
| 5,678,521 | A * | 10/1997 | Thompson et al. | 123/447 |
| 6,526,947 | B2 | 3/2003 | Shimada et al. | |
| 6,659,085 | B2 | 12/2003 | Kojima | |
| 6,694,952 | B1 * | 2/2004 | Yamazaki et al. | 123/496 |

FOREIGN PATENT DOCUMENTS

| | | | |
|---|---|---|---|
| DE | 695 25 986 | T2 | 12/2002 |
| JP | 2001-182597 | A | 7/2001 |
| JP | 2002-309988 | A | 10/2002 |
| JP | 2003-155961 | A * | 5/2003 |
| JP | 2004-019608 | A | 1/2004 |
| JP | 2005-282388 | A | 10/2005 |

* cited by examiner

*Primary Examiner* — Hieu T Vo
(74) *Attorney, Agent, or Firm* — Sughrue Mion, PLLC

(57) ABSTRACT

In a high pressure fuel pump control apparatus for an internal combustion engine which has a high pressure fuel pump of an engine driven type capable of pressure feeding a controlled amount of fuel by driving a fuel suction valve to close at predetermined timing in a fuel delivery stroke, fuel pressure in an accumulator is swiftly raised by reliably pressure feeding a maximum amount of fuel from a fuel delivery stroke immediately after engine starting while avoiding heat generation by a solenoid for controlling the fuel suction valve, whereby deterioration of a combustion state and exhaust emissions at engine starting can be prevented. A starting time control section continuously energizes the solenoid over a period from the beginning of engine starting until when it becomes possible to perform valve closing timing control on the fuel suction valve based on the rotational position of the engine after completion of cylinder identification.

6 Claims, 7 Drawing Sheets

HIGH PRESSURE FUEL PUMP CONTROL APPARATUS FOR AN INTERNAL COMBUSTION ENGINE

BACKGROUND OF THE INVENTION

1. Field of the Invention

The present invention relates to a high pressure fuel pump control apparatus for an internal combustion engine of a direct injection type, for example. In particular, the invention relates to a technique for facilitating the rising of fuel pressure when an internal combustion engine is started in a state where the pressure of fuel in an accumulator is low (e.g., after the internal combustion engine has been left stopped).

2. Description of the Related Art

Conventionally, in direct injection type internal combustion engines in which fuel is directly supplied by injection to a combustion chamber in each cylinder, the pressure of fuel is raised by pressurizing the fuel to be supplied to each fuel injection valve up to an optimal pressure (a target pressure) for combustion thereof by using a high pressure fuel pump.

In a high pressure fuel pump control apparatus for this kind of internal combustion engine, when the identification of cylinders in the internal combustion engine has been completed, an amount of fuel to be delivered from a high pressure fuel pump necessary to make the fuel pressure in an accumulator detected by a fuel pressure sensor coincide with a target pressure, and a fuel suction valve is closed at predetermined timing in a fuel delivery stroke of the high pressure fuel pump based on the rotational position of the internal combustion engine, whereby the energization timing of a solenoid for the fuel suction valve is controlled so as to deliver a desired amount of fuel from the high pressure fuel pump.

Here, note that the amount of delivery fuel required to make the fuel pressure in the accumulator coincide with the target pressure is calculated according to a proportional integral calculation, etc., based for example on a pressure deviation between a detection value of the fuel pressure detected by the fuel pressure sensor and the target pressure.

The required amount of delivery fuel thus calculated is converted into a corresponding drive timing of the fuel suction valve by using a valve closing drive timing map for the fuel suction valve. The valve closing drive timing map is map data that shows the relation between the valve closing timing of the fuel suction valve and the fuel delivery amount of the high pressure fuel pump, and is stored in advance in a memory in the control apparatus.

A desired amount of fuel is delivered from the high pressure fuel pump by controlling the energization timing of the solenoid in such a manner that the fuel suction valve is closed at the drive timing thus obtained, whereby the fuel pressure in the accumulator is controlled so as to coincide with the target pressure.

However, the fuel pressure in the accumulator is substantially reduced up to the atmospheric pressure at the start-up of the internal combustion engine, so it is necessary to swiftly raise the fuel pressure in the accumulator so as to make it possible to perform a good injection of fuel. Accordingly, in the high pressure fuel pump, it is required to pressure feed as much amount of fuel as possible to the accumulator by driving the fuel suction valve to close at once from a fuel delivery stroke immediately after the beginning of engine starting.

At the start-up of the internal combustion engine, however, a determination as to whether the stroke of the high pressure fuel pump being in synchronization with the rotation of the internal combustion engine is a fuel suction stroke or a fuel delivery stroke can not be made until a time point at which the cylinder identification based on a predetermined pulse signal pattern output from a rotational position sensor (a crank angle sensor or a cam angle sensor) has been completed (i.e., a time point at which the rotational position of the internal combustion engine is fixedly decided). As a result, it is impossible to control the fuel suction valve to close on a fuel delivery stroke before the cylinder identification has been completed. Thus, the solenoid is controlled to be in a non-energized state over a period of time from the beginning of engine starting until the completion of the cylinder identification, and the fuel suction valve continues to be opened, so the pressure feeding of fuel by the high pressure fuel pump is not performed.

Here, note that a low pressure fuel pump arranged at an upstream side of the high pressure fuel pump is of an electrically driven type, and is able to pressure feed fuel at a rated delivery pressure from the beginning of engine starting. Accordingly, the delivery pressure of the low pressure fuel pump acts on the accumulator via the high pressure fuel pump in a period of time from the beginning of engine starting until the completion of the cylinder identification, thereby making it possible to raise the pressure in the accumulator to a rated delivery pressure (e.g., 0.3 MPa) of the low pressure fuel pump. However, this rated delivery pressure is very low as compared with the target pressure (e.g., 7 MPa) in the accumulator in normal operation time, and hence it is difficult to achieve the injection of fuel that is able to obtain a good combustion state.

Accordingly, there has been proposed an apparatus that serves to perform intermittent energization (repetition of on/off) of a solenoid in a period of time from the beginning of engine starting until the completion of the cylinder identification (see, for example, a first patent document (Japanese patent application laid-open No. 2001-182597) and a second patent document (Japanese patent application laid-open No. 2002-309988). According to techniques as described in the first and second patent documents, even in a period of time prior to the cylinder identification in which the rotational position of an internal combustion engine has not yet been detected, a fuel suction valve is driven to close as long as a fuel delivery stroke period that comes after the beginning of engine starting and an on period of a solenoid overlap with each other, whereby fuel is pressure fed from a high pressure fuel pump to an accumulator, thereby facilitating the pressure rising of fuel therein.

In the above-mentioned conventional high pressure fuel pump control apparatuses for an internal combustion engine, there is the following problem. That is, the fuel suction valve is driven to close subject to the condition that the fuel delivery stroke period following the beginning of engine starting and the on period of the solenoid overlap with each other, so it is impossible to achieve the delivery of fuel at a maximum amount that can be output by the high pressure fuel pump as long as the bottom dead center of the fuel delivery stroke (the first or start position of the fuel delivery stroke) and the on period of the solenoid do not overlap with each other superpose by chance.

In addition, the valve closing timing of the fuel suction valve at engine starting becomes a probabilistic or rare operation, so the amount of delivery fuel varies each time the engine is started, and hence the fuel pressure becomes unstable. thus giving rise to a problem that deterioration of the combustion state and exhaust emissions at engine starting might be caused.

For the second-mentioned problem, it is considered to take a countermeasure of setting the on period of the solenoid during the intermittent energization thereof to a long time, but if the on period is set long, the excessive generation of heat of the solenoid becomes aggravated, and a possibility of impairing reliability occurs, so the on period can not in fact be set long.

SUMMARY OF THE INVENTION

Accordingly, the present invention is intended to obviate the problems as referred to above, and has for its object to obtain a high pressure fuel pump control apparatus for an internal combustion engine which has a high pressure fuel pump of an engine driven type capable of pressure feeding a controlled amount of fuel by driving a fuel suction valve to close at predetermined timing in a fuel delivery stroke, and which serves to swiftly raise the fuel pressure in an accumulator so as to prevent the deterioration of a combustion state and exhaust emissions at the time of engine starting by pressure feeding a maximum amount of fuel in a reliable manner from a fuel delivery stroke immediately after the start-up of the internal combustion engine.

Bearing the above object in mind, a high pressure fuel pump control apparatus for an internal combustion engine according to the present invention includes: a rotational position sensor that outputs a predetermined pulse signal in accordance with the rotational position of an internal combustion engine; a high pressure fuel pump that has a solenoid for opening and closing a fuel suction valve arranged between a fuel suction port and a pressure chamber, and serves to pressurize fuel supplied from the fuel suction port to the pressure chamber through the fuel suction valve and deliver it from a fuel delivery port; an accumulator that accumulates the fuel delivered from the high pressure fuel pump; a fuel pressure sensor that detects the pressure of fuel in the accumulator; and a control section that performs identification of cylinders of the internal combustion engine based on the predetermined pulse signal, and controls the energization timing of the solenoid based on a detected value of the fuel pressure. When the cylinder identification of the internal combustion engine is completed, the control section controls the energization timing of the solenoid based on the rotational position of the internal combustion engine, whereby valve closing timing of the fuel suction valve is controlled to deliver, from the high pressure fuel pump, an amount of fuel necessary to make the detected value of the fuel pressure coincide with a target pressure. The control section includes a starting time control section for continuously energizing the solenoid over a period of time from a time point at which the internal combustion engine begins to be started until a time point at which the cylinder identification is completed to make it possible to control the valve closing timing of the fuel suction valve.

According to the present invention, in a high pressure fuel pump control apparatus for an internal combustion engine which has a high pressure fuel pump of an engine driven type capable of pressure feeding a controlled amount of fuel by driving a fuel suction valve to close at predetermined timing in a fuel delivery stroke, it is possible to swiftly raise the fuel pressure in an accumulator so as to prevent the deterioration of a combustion state and an exhaust emissions at the time of engine starting by pressure feeding a maximum amount of fuel in a reliable manner from a fuel delivery stroke immediately after the start-up of the internal combustion engine.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Now, preferred embodiments of the present invention will be described below in detail while referring to the accompanying drawings.

Embodiment 1

Figure 1:
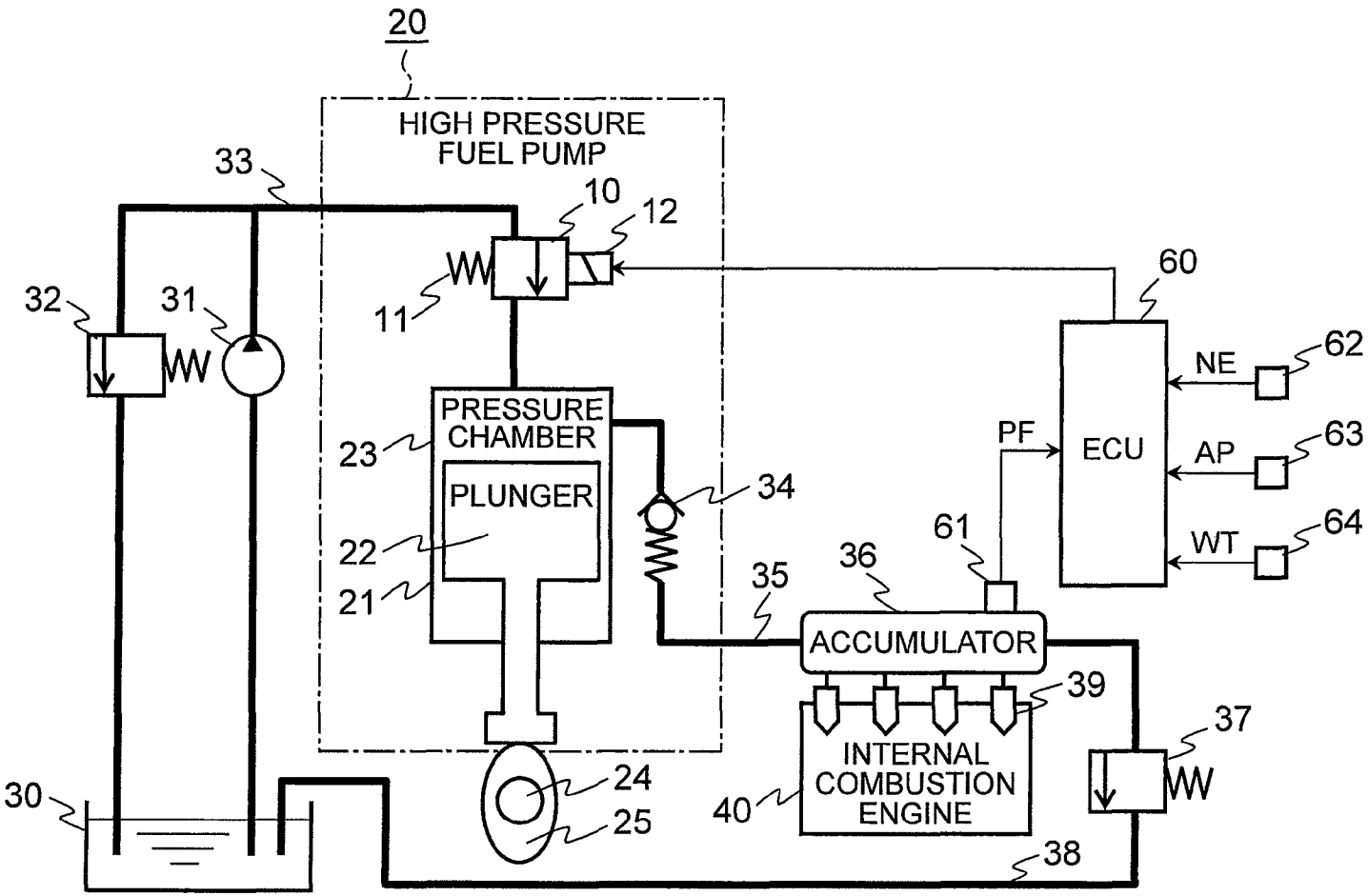
FIG. 1 is a block diagram schematically showing a high pressure fuel pump control apparatus for an engine according to a first embodiment of the present invention.

Referring to the drawings and first to FIG. 1, there is schematically shown a high pressure fuel pump control apparatus for an engine according to a first embodiment of the present invention.

In FIG. 1, the high pressure fuel pump control apparatus for an internal combustion engine includes, as a fuel supply system for an internal combustion engine 40, a high pressure fuel pump 20 adapted to operate in synchronization with a pump cam 25 formed integral with a camshaft 24 of the internal combustion engine 40, a fuel tank 30 having fuel filled therein, a low pressure passage 33 connected to the fuel tank 30 through a low pressure fuel pump 31 and a low pressure regulator 32, a high pressure passage (delivery passage) 35 connected to an accumulator 36 through a fuel delivery valve 34, a relief passage 38 connecting between the accumulator 36 and the fuel tank 30 through a relief valve 37, and fuel injection valves 39 for supplying by injection the fuel accumulated in the accumulator 36 to individual combustion chambers of the internal combustion engine 40.

The high pressure fuel pump 20 is provided with a fuel suction valve 10 of a normally open type having a valve closing spring 11 and a solenoid 12, and a cylinder 21 having a plunger 22 and a pressure chamber 23, and a fuel delivery valve (check valve) 34. The solenoid 12 operates to open and close the fuel suction valve 10 arranged between a fuel suction port and the pressure chamber 23. Here, note that a valve-opening spring (to be described later) is arranged in the solenoid 12.

With the above construction, the high pressure fuel pump 20 operates to raise the fuel supplied from the fuel suction port to the pressure chamber 23 through the fuel suction valve 10, and deliver it from a fuel delivery port through the fuel delivery valve 34.

The accumulator 36 accumulates the fuel delivered from the high pressure fuel pump 20, and the fuel injection valves 39 serve to supply, by direct injection, the high pressure fuel in the accumulator 36 to the individual combustion chambers of the respective cylinders of the internal combustion engine 40.

In addition, the high pressure fuel pump control apparatus for an internal combustion engine is also provided, as a control system (control section), with an ECU (electronic control unit) 60 that energizes the solenoid 12 thereby to control valve closing timing TD of the fuel suction valve 10 (delivery timing of pressurized fuel).

The ECU 60 includes a target pressure setting section, a target delivery amount calculation section, a valve closing timing decision section, a cylinder identification section, a drive method switching section, a starting time control section, etc., as will be described later. In addition, detection signals from a various kinds of sensors such as a fuel pressure sensor 61, a rotational position sensor 62, an accelerator position sensor 63, an engine temperature sensor 64, etc., are input to the ECU 60 as operating information on the internal combustion engine 40.

The rotational position sensor 62 generates a predetermined pulse signal (corresponding to a rotational speed NE) in accordance with the rotational position of the internal combustion engine 40, and inputs it to the ECU 60. The fuel pressure sensor 61 detects a fuel pressure PF in the accumulator 36, and inputs it to the ECU 60, The ECU 60 (control section) performs the identification of cylinders of the internal combustion engine 40 based on the predetermined pulse signal, and controls the energization timing of the solenoid 12 based on the detected value of the fuel pressure PF.

Also, when the cylinder identification of the internal combustion engine 40 is completed, as previously stated, the ECU 60 controls the energization (excitation) timing of the solenoid 12 based on the rotational position of the internal combustion engine 40, whereby the valve closing timing TD of the fuel suction valve 10 is controlled to deliver, from the high pressure fuel pump 20, an amount of fuel necessary to make the detected value of the fuel pressure PF coincide with the target pressure PO.

Further, the starting time control section (to be described later) in the ECU 60 continuously energizes the solenoid 12 over a period of time from the time point at which the internal combustion engine 40 begins to be started until the time point at which the cylinder identification is completed to make it possible to control the valve closing timing of the fuel suction valve 10.

In the fuel supply system, the low pressure fuel pump 31 serves to draw up fuel in the fuel tank 30 and deliver it to the low pressure passage 33, and the high pressure fuel pump 20 serves to suck the fuel delivered from the low pressure fuel pump 31 into the pressure chamber 23 and deliver it therefrom.

The low pressure passage 33 is connected from the fuel suction port in the high pressure fuel pump 20 to an upstream side of the pressure chamber 23 through the fuel suction valve 10. That is, the fuel suction valve 10 is disposed in a fuel passage connecting between the low pressure passage 33 and the pressure chamber 23. Also, the fuel delivery valve 34 is disposed in the high pressure passage 35 connecting between the pressure chamber 23 and the accumulator 36.

In the low pressure passage 33 side of the fuel supply system, the fuel delivered from the low pressure fuel pump 31 is adjusted to a predetermined low pressure value (e.g., 0.3 MPa) by the low pressure regulator 32, and it is introduced into the pressure chamber 23 through the opened fuel suction valve 10 when the plunger 22 moves downward in the cylinder 21.

The plunger 22 reciprocates in the cylinder 21 in synchronization with the rotation of the internal combustion engine 40. As a result, the high pressure fuel pump 20 sucks fuel from the low pressure passage 33 into the pressure chamber 23 through the opened fuel suction valve 10 in a descending period of the plunger 22, and pressurizes the fuel in the pressure chamber 23 to a high pressure thereby to supply it to the accumulator 36 through the fuel delivery valve 34 during the closure of the fuel suction valve 10 in an ascending period of the plunger 22. The pressure chamber 23 is defined by an inner peripheral wall surface of the cylinder 21 and an upper end face of the plunger 22.

A lower end of the plunger 22 is in pressure contact with the pump cam 25 mounted on the camshaft 24 of the internal combustion engine 40, so that the plunger 22 is caused to reciprocate in the cylinder 21 by the pump cam 25 which is driven to rotate in conjunction with the rotation of the camshaft 24, whereby the volume of the pressure chamber 23 is changed to expand and contract.

The high pressure passage 35 connected to a downstream side of the pressure chamber 23 is connected to the accumulator 36 through the fuel delivery valve 34 of the normally closed type in the form of a check valve that permits fuel to pass only in a direction from the pressure chamber 23 toward the accumulator 36.

The accumulator 36 accumulates and holds the high pressure fuel delivered from the pressure chamber 23, and it is connected in common to the individual fuel injection valves 39 of the internal combustion engine 40 for distributing the high pressure fuel thus accumulated to the fuel injection valves 39, respectively.

The relief valve 37 connected to the accumulator 36 is in the form of a normally closed valve that is opened at a fuel pressure higher than a predetermined fuel pressure (valve-opening pressure set value), and it is opened when the fuel pressure in the accumulator 36 is going to rise to the set value of the valve-opening pressure of the relief valve 37 or above. As a result, the fuel in the actuator 36, being about to rise to the valve-opening pressure set value or above, is returned to the fuel tank 30 through the relief passage 38, whereby the fuel pressure in the accumulator 36 is prevented from becoming excessively large.

The fuel suction valve 10, being arranged in the low pressure passage 33 connecting between the low pressure fuel pump 31 and the pressure chamber 23, is controlled in its valve closing drive timing (i.e., the excitation of the solenoid 12 is controlled) by means of the ECU 60, so that the amount of delivery fuel from the high pressure fuel pump 20 to the accumulator 36 can be adjusted in an appropriate manner.

In the high pressure fuel pump 20, when the plunger 22 is driven to move in the cylinder 21 in an upward direction (i.e., the volume of the pressure chamber 23 is decreased), the fuel sucked into the pressure chamber 23 is returned from the pressure chamber 23 to the low pressure passage 33 through the fuel suction valve 10 in accordance with the upward movement of the plunger 22 during the valve-opening operation of the fuel suction valve 10 (deenergization of the solenoid 12). As a result, the high pressure fuel is not supplied to the accumulator 36.

On the other hand, after the fuel suction valve 10 is controlled to be closed (i.e., the solenoid 12 is energized) at predetermined timing in the upward movement of the plunger 22 in the cylinder 21, the fuel pressurized in the pressure chamber 23 in accordance with the upward movement of the plunger 22 is delivered from the fuel delivery valve 34 to the fuel delivery port of the high pressure fuel pump 20, and is pressure fed therefrom to the accumulator 36 through the high pressure passage 35.

The ECU 60 takes in, as various kinds of operating state information, the fuel pressure PF in the accumulator 36 detected by the fuel pressure sensor 61, the rotational position and the rotational speed NE of the internal combustion engine 40 detected by the rotational position sensor 62, the amount of depression AP of an accelerator pedal (not shown) detected by the accelerator position sensor 63, the engine temperature WT of the internal combustion engine 40 detected by the engine temperature sensor 64, etc.

Hereinafter, the ECU 60 decides a target pressure PO based on the rotational speed NE and the accelerator pedal depression amount AP, calculates a target amount of delivery fuel QO necessary to make the fuel pressure PF in the accumulator 36 coincide with the target pressure PO, and decides the valve closing drive timing (i.e., energization timing of the solenoid 12) of the fuel suction valve 10 in accordance with the target amount of delivery fuel QO, whereby the amount of fuel delivered from the high pressure fuel pump 20 to the accumulator 36 is controlled.

Next, reference will be made to a specific configuration of the ECU 60 according to the present invention while referring to a functional block diagram in FIG. 2.

Figure 2:
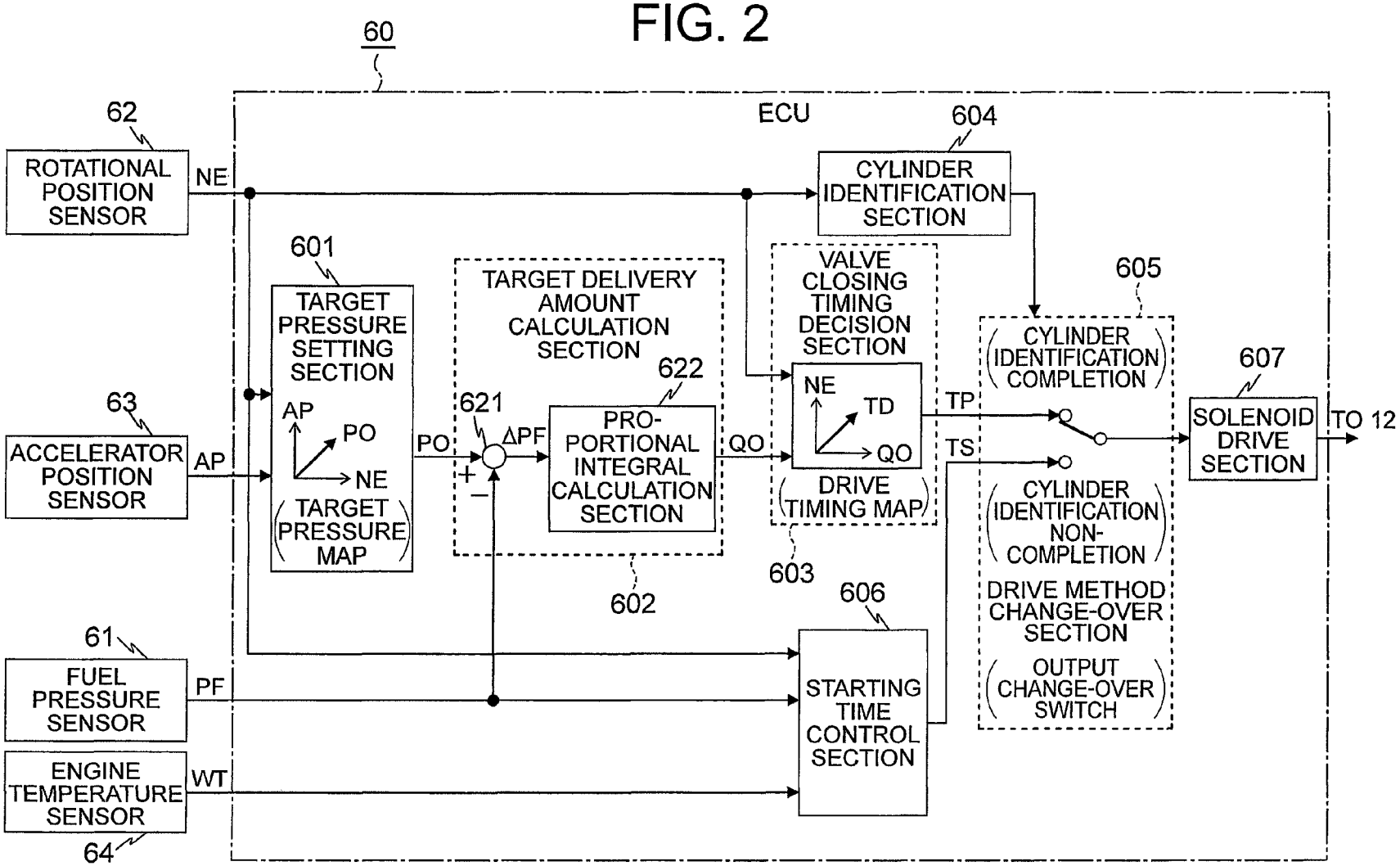
FIG. 2 is a functional block diagram illustrating a specific configuration of an ECU in FIG. 1.

In FIG. 2, the ECU 60 calculates the drive timing of the solenoid 12 based on the detected value of the fuel pressure PF in the accumulator 36 input from the fuel pressure sensor 61, the detected value of the rotational position or rotational speed NE of the internal combustion engine 40 input from the rotational position sensor 62, the detected value of the accelerator pedal depression amount AP from the accelerator position sensor 63, the detected value of the engine temperature WT of the internal combustion engine 40 input from the engine temperature sensor 64, and the detected information of other various kinds of sensors (not shown), and controls the valve-closing/valve-opening timing (on/off of the solenoid 12) of the fuel suction valve 10.

In order to execute the above processing, the ECU 60 includes a target pressure setting section (target pressure map) 601 that sets the target pressure PO in the accumulator 36, a target delivery amount calculation section 602 that calculates the target amount of delivery fuel QO for the high pressure fuel pump 20, a valve closing timing decision section (drive timing map) 603 that outputs a timing pulse TP corresponding to the valve closing timing TD of the fuel suction valve 10, a cylinder identification section 604 that identifies a control target cylinder (i.e., a cylinder to be controlled) of the internal combustion engine 40, a drive method change-over section (output change-over switch) 605 that changes over a drive method for the solenoid 12 in accordance with the presence or absence of the completion of cylinder identification, a starting time control section 606 that performs control at the start-up of the internal combustion engine 40, and a solenoid drive section 607 that drives the solenoid 12.

The target delivery amount calculation section 602 includes a subtracter 621 that calculates a pressure deviation ΔPF between the target pressure PO decided by the target pressure setting section 601 and the detected value of the fuel pressure PF, and a proportional integral calculation section 622 that calculates the target amount of delivery fuel QO according to a proportional integral calculation based on the pressure deviation ΔPF.

The starting time control section 606 outputs a continuous energization pulse TS to the solenoid 12 at the start-up of the internal combustion engine 40 based on the individual detected values from the fuel pressure sensor 61 and the engine temperature sensor 64 and a predetermined pulse signal from the rotational position sensor 62.

Hereinafter, reference will be made to the calculation processing operation of the ECU 60 according to this first embodiment of the present invention, as shown in FIG. 2.

In a state in which the cylinder identification of the internal combustion engine 40 is completed, first of all, the target pressure setting section 601 in the ECU 60 decides the target pressure PO based on the target pressure map from the individual detected values of the rotational speed NE and the accelerator pedal depression amount AP, and inputs it to the target delivery amount calculation section 602.

In the target delivery amount calculation section 602, The subtracter 621 calculates the pressure deviation ΔPF between the target pressure PO decided by the target pressure setting section 601 and the detected value of the fuel pressure PF. Also, the proportional integral calculation section 622 calculates the target amount of delivery fuel QO according to a proportional integral calculation based on the calculated value of the pressure deviation ΔPF, and inputs it to the valve closing timing decision section 603.

Subsequently, the valve closing timing decision section 603 decides the valve closing timing TD (fuel delivery timing) of the fuel suction valve 10 from the calculated value of the target amount of delivery fuel QO and the detected value of the rotational speed NE based on the drive timing map. At this time, the valve closing timing decision section 603 outputs the timing pulse TP (corresponding to the valve closing timing TD) based on the valve closing timing TD decided with the drive timing map and the rotational position information on the internal combustion engine 40 (predetermined pulse signal), during a period of time in which the internal combustion engine 40 takes a predetermined rotational position.

On the other hand, the cylinder identification section 604 performs identification processing of the rotational position of the internal combustion engine 40 based on the rotational position and/or the rotational speed NE of the internal combustion engine 40, and inputs to the drive method change-over section 605 an identification result indicating that the cylinder identification has been completed or has not yet been completed.

The drive method change-over section 605 changes over the output change-over switch in accordance with the identification result from the cylinder identification section 604 in the following manner. That is, when the cylinder identification has been completed, the drive method change-over section 605 assumes that the timing control in normal operation is executable, and changes over the output change-over switch to a "cylinder identification completion" side so that the timing pulse TP from the valve closing timing decision section 603 is input to the solenoid drive section 607. Accordingly, the solenoid 12 is energized in accordance with the timing pulse TP, and the fuel suction valve 10 is driven to close at predetermined timing in accordance with the energization of the solenoid 12. As a result, the amount of fuel necessary to make the fuel pressure PF coincide with the target pressure PO is pressure fed from the high pressure fuel pump 20 to the accumulator 36.

On the other hand, when the cylinder identification has not yet been completed, the drive method change-over section 605 assumes that the timing control in normal operation is not executable, and changes over the output change-over switch to a "cylinder identification non-completion" side so that the continuous energization pulse TS from the starting time control section 606 is input to the solenoid drive section 607.

Accordingly, the solenoid 12 is continuously energized in accordance with the timing pulse TP, whereby the fuel suction valve 10 is driven to close during the period of a fuel delivery stroke, so the cylinder identification is pressure fed and a maximum deliverable amount of fuel is pressure fed from the high pressure fuel pump 20 to the accumulator 36 over a period of non-completion of the cylinder identification.

Here, specific reference will be made to the function of the starting time control section 606.

First of all, the starting time control section 606 determines the state of start-up of the engine) (i.e., whether the engine is in an engine starting state) depending upon whether the pulse signal from the rotational position sensor 62 has changed from the state of "absence of a pulse signal input (during engine stoppage)" into the state of "presence of a pulse signal input (during engine starting)".

When it is determined that the internal combustion engine 40 is in the engine starting state, the starting time control section 606 outputs a continuous energization pulse TS, whereas when it is determined that the internal combustion engine 40 is not in the engine starting state, the starting time control section 606 inhibits outputting a continuous energization pulse TS.

In addition, when the detected value of the fuel pressure PF is above and the fuel pressure PF has exceeded a predetermined determination pressure PFr (i.e., set beforehand in accordance with the engine temperature WT) on the basis of the individual detected values of the fuel pressure PF and the engine temperature WT, the starting time control section 606 inhibits the outputting of the continuous energization pulse TS. With this function, the amount of injection fuel at low temperatures (cold engine starting) can be prevented from being increased, thereby making it possible to avoid excessive lowering of the fuel pressure PF during engine starting. Moreover, it can be avoided that the fuel pressure PF excessively rises too much when the engine is started after having been warmed up, or when the engine is started from a state in which the fuel pressure PF before engine starting is relatively high.

Further, the starting time control section 606 monitors the duration of the continuous energization pulse TS during the output of the continuous energization pulse TS, and also inhibits the output of the continuous energization pulse TS when the duration of the continuous energization pulse TS exceeds a predetermined maximum time (an allowable range in the state of normal operation) which has been set beforehand. With this function, it is possible to avoid abnormal heating of the solenoid 12 even when there occurs a situation where an abnormally long time has elapsed from the beginning of engine starting until the completion of cylinder identification.

Also, when it is determined that the detected values from the fuel pressure sensor 61 and the rotational position sensor 62 are abnormal (sensor fault), the starting time control section 606 inhibits the outputting of the continuous energization pulse TS. Owing to this function, it is possible to avoid misetting the determination pressure PFr based on incorrect fuel pressure information. In addition, even when there occurs an abnormality (failure) that cylinder identification has not been completed over a long time, it is possible to avoid a situation where the energization or current supply duration might be so lengthened as to abnormally heat the solenoid 12.

Now, reference will be made to the control operation of the ECU 60 according to the first embodiment of the present invention as illustrated in FIGS. 1 and 2 while referring to a timing chart in FIG. 3.

Figure 3:
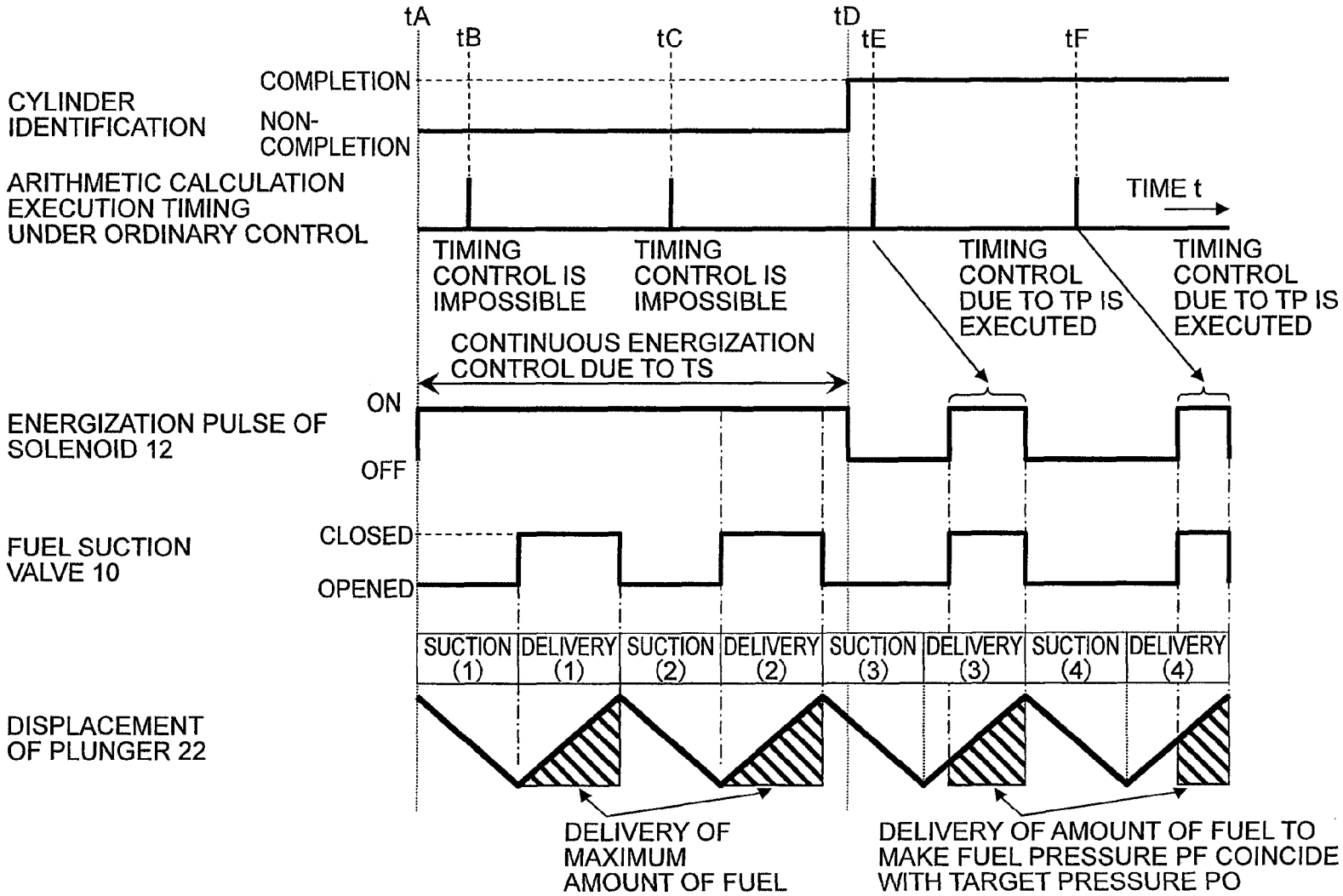
FIG. 3 is a timing chart illustrating a control operation according to the first embodiment of the present invention.

In FIG. 3, the axis of abscissa represents the elapse of time t, wherein time points tA through tF in the form of key points for individual control operations are attached, and time point tA indicates a time point at which the internal combustion engine 40 begins to be started up (i.e., a time point when a starter switch is turned on).

In addition, in FIG. 3, the axes of ordinate represent, sequentially from top to bottom, the "completion/non-completion" state of cylinder identification, calculation execution timing (time points tB, tC, tE, tF) at the time of ordinary control, the "on/off" state of the energization pulse for the solenoid 12, the "valve-opening/valve-closing" state of the fuel suction valve 10, the displacement of the plunger 22.

Here, note that in the displacement of the plunger 22, the characters "SUCTION (1) through SUCTION (4)" and "DELIVERY (1) through DELIVERY (4)" described at an upper row mean the high pressure fuel pump 20 is in "fuel suction strokes", and in "fuel delivery strokes" respectively. In addition, the shaded or hatched portions in a displacement waveform of the plunger 22 indicate fuel delivery periods, respectively.

As shown in FIG. 3, when the internal combustion engine 40 begins to be started up at time point tA, the plunger 22 of the high pressure fuel pump 20 is caused to displace by the rotation of the camshaft 24 and the pump cam 25, whereby the high pressure fuel pump 20 repeatedly performs a fuel suction stroke and a fuel delivery stroke in a periodic manner.

Although in FIG. 3, there is shown by way of example a case where the plunger 22 starts to operate from the top dead center of a fuel suction stroke, the plunger 22 can start to operate from an arbitrary position in accordance with the state thereof when the engine was stopped last time.

When the internal combustion engine 40 begins to be started up at time point tA, a predetermined pulse signal comes to be output from the rotational position sensor 62, as shown in FIG. 3, but this pulse signal is continuously generated in accordance with a predetermined rotational position of the internal combustion engine 40, so the identification of cylinders should not be completed until after a predetermined number of pulse signals or more have been detected. In this case, it is a time point tD that the cylinder identification has been completed and the rotational position of the internal combustion engine 40 can be fixedly decided.

Accordingly, for a period from the time point tA at which the engine starting begins until the time point tD at which the cylinder identification can be completed, the rotational position of the internal combustion engine 40 has not yet been fixed, so even if arithmetic calculation execution timings (time point tB and time point tC) at the time of ordinary control have come during such a period, timing control should not actually be performed.

Accordingly, continuous energization control on the solenoid 12 is carried out by means of the continuous energization pulse TS over the period from time point tA to time point tD. As a result, in the "fuel suction stroke (1)" and "fuel suction stroke (2)" (descending periods of the plunger 22) as indicated by "SUCTION (1)" and "SUCTION (2)", respectively, in FIG. 3, fuel is sucked through the fuel suction valve 10 which remains opened.

Subsequently, in the "fuel delivery stroke (1)" and "fuel delivery stroke (2)" (ascending periods of the plunger 22) as indicated by "DELIVERY (1)" and "DELIVERY (2)", respectively, the fuel suction valve 10 is closed from the top or first (bottom dead center) position of the fuel delivery stroke, so that the "pressure feeding of fuel at a maximum capacity" of the high pressure fuel pump 20 (see shaded portions) in the engine starting state can be achieved.

Although in FIG. 3, there is shown the case where the continuous energization pulse TS is terminated at the time of the completion of the cylinder identification (time point tD), the continuous energization pulse TS may instead be terminated at the time when arithmetic calculation execution timing under the ordinary control comes (i.e., at time point tE) after the completion of the cylinder identification (time point tD). For example, with respect to which time during a period from completion of the cylinder identification (time point tD) until the arithmetic calculation execution timing (time point tE) under the ordinary control coming after the completion of the cylinder identification, the continuous energization pulse TS is to be terminated, it is necessary to select appropriate timing in consideration of the phase relation between the arithmetic calculation execution timing under the ordinary control and the pump cam 25.

After the completion of the cylinder identification, the rotational position of the internal combustion engine 40 is found at the arithmetic calculation execution timings (at time point tE and time point tF), so it becomes possible to execute the timing control in ordinary operation. Accordingly, at time point tE and at time point tF, the energization of the solenoid 12 is controlled according to the timing pulse TP output from the valve closing timing decision section 603, whereby the fuel suction valve 10 is driven to close at predetermined timing thereby to pressure feed an amount of fuel necessary to make the fuel pressure PF coincide with the target pressure PO.

Now, reference will be made to a basic control operation procedure by the drive method change-over section 605 and the starting time control section according to the first embodiment of the present invention while referring to a flow chart in FIG. 4. Here, note that the starting time control section 606 can include the function of the drive method change-over section 605, so the following description will be given on the assumption that the starting time control section 606 includes the drive method change-over section 605.

Figure 4:
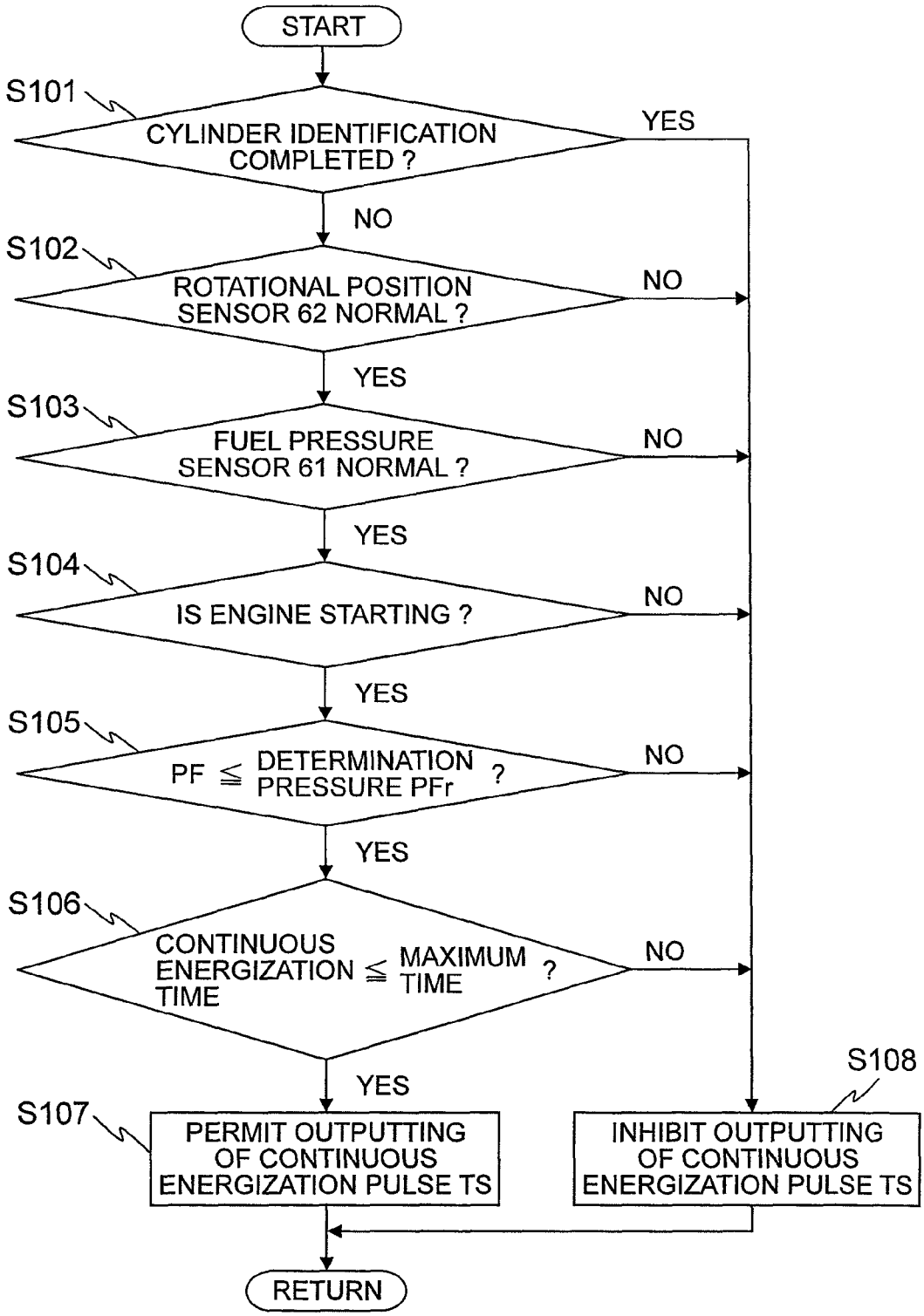
FIG. 4 is a flow chart illustrating the control operation according to the first embodiment of the present invention.

In FIG. 4, first of all, the starting time control section 606 (or the drive method change-over section 605) determines, based on the cylinder identification result of the cylinder identification section 604, whether the cylinder identification has been completed (step S101). When it is determined that the cylinder identification has been completed (that is, YES), the output change-over switch is operated to the "cylinder identification completion", and the outputting of the continuous energization pulse TS by the starting time control section 606 is inhibited (step S108), after which the processing routine of FIG. 4 is exited.

On the other hand, when it is determined in step S101 that the cylinder identification has not been completed (that is, NO), the starting time control section 606 subsequently makes a determination as to whether the rotational position sensor 62 is normal (step S102). When it is determined that the rotational position sensor 62 is abnormal (in failure) (that is, NO), the control flow proceeds to the above-mentioned step S108, where the outputting of the continuous energization pulse TS is inhibited, and the processing routine of FIG. 4 is then exited.

On the other hand, when it is determined in step S102 that the rotational position sensor 62 is normal (that is, YES), the starting time control section 606 subsequently determines whether the fuel pressure sensor 61 is normal (step S103). When it is determined that the fuel pressure sensor 61 is abnormal (in failure) (that is, NO), the control flow proceeds to the above-mentioned step S108, where the outputting of the continuous energization pulse TS is inhibited, and the processing routine of FIG. 4 is then exited.

On the other hand, when it is determined in step S103 that the fuel pressure sensor 61 is normal (that is, YES), the starting time control section 606 subsequently determines whether the internal combustion engine 40 is being started (step S104). When it is determined that the internal combustion engine 40 is not being started (that is, NO), the control flow proceeds to step S108, where the outputting of the continuous energization pulse TS is inhibited, and the processing routine of FIG. 4 is then exited.

On the other hand, when it is determined in step S104 that the internal combustion engine 40 is being started (that is, YES), the starting time control section 606 subsequently determines whether the detected value of the fuel pressure PF is equal to or less than a predetermined determination pressure PFr (step S105). When it is determined as PF≧PFr (that is, NO), the control flow proceeds to the above-mentioned step S108, where the outputting of the continuous energization pulse TS is inhibited, and the processing routine of FIG. 4 is then exited.

On the other hand, when it is determined as PF≦PFr in step S105 (that is, YES), the starting time control section 606 subsequently determines whether the energization or current supply duration of the continuous energization pulse TS (continuous energization or current supply duration to the solenoid 12) is equal to or less than a maximum time (i.e., within an allowable range in which overheat damage of the solenoid 12, etc., does not occur) (step S106). When it is determined as the continuous energization duration>the maximum time in step S106 (that is, NO), the control flow proceeds to the above-mentioned step S108, where the outputting of the continuous energization pulse TS is inhibited, and the processing routine of FIG. 4 is then exited.

On the other hand, when it is determined as the continuous energization duration≦the maximum time in step S106 (that is, YES), the starting time control section 606 operates the output change-over switch to the "cylinder identification non-completion" side thereby to permit the outputting of the continuous energization pulse TS (step S107), and the processing routine of FIG. 4 is then exited.

Thereafter, the continuous energization pulse TS is kept being output through the drive method change-over section 607 until the time when a condition to pass through the step S108 comes to hold, whereby the continuous energization of the solenoid 12 is continued.

Here, note that when the cylinder identification in the cylinder identification section 604 has been completed, the output change-over switch in the drive method change-over section 605 is change over to the "cylinder identification completion" side. Accordingly, the timing control of the solenoid 12 (the fuel suction valve 10) is executed by the timing pulse TP under the ordinary control which is decided by the target pressure setting section 601, the target delivery amount calculation section 602 and the valve closing timing decision section 603.

Next, a supplementary explanation will be made to an output permission/output inhibition function for the continuous energization pulse TS performed by the starting time control section 606 while referring to a characteristic view in FIG. 5.

As stated above, the starting time control section 606 permits or inhibits the outputting of the continuous energization pulse TS based on the result of a comparison between the determination pressure PFr corresponding to the engine temperature WT and the detected value of the fuel pressure PF.

Figure 5:
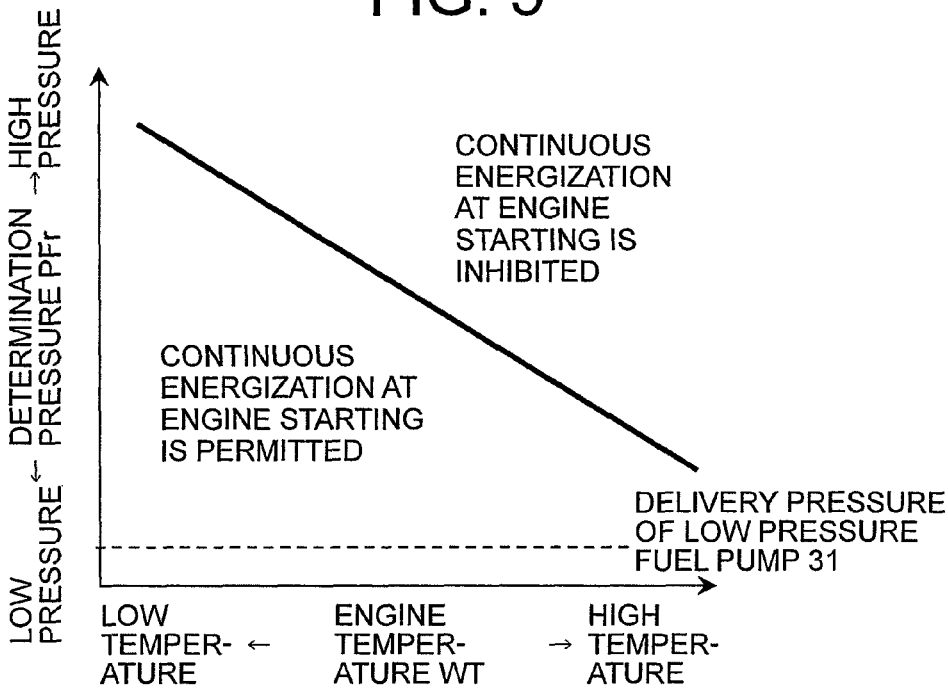
FIG. 5 is a characteristic view showing a set value of a determination pressure for output permission/inhibition a continuous energization pulse in the first embodiment of the present invention.

In FIG. 5, the determination pressure PFr is set to a value (shown, by way of example, as a negative linear function) that varies in accordance with the engine temperature WT, with the delivery pressure of the low pressure fuel pump 31 (see a broken line) being as a lower limit value, so that it is set to a lower pressure in accordance with the rising temperature (cooling water temperature) WT of the internal combustion engine 40. Although in FIG. 5, the determination pressure PFr is set as varying linearly with respect to the engine temperature WT, in actuality, an appropriate determination pressure PFr for each engine temperature WT is experimentally decided in accordance with the starting performance of the internal combustion engine 40, so the determination pressure PFr is not limited to the characteristic of FIG. 5.

When the engine temperature WT is high, the continuous energization of the solenoid 12 by the continuous energization pulse TS at engine starting is inhibited by the determination pressure PFr as shown in FIG. 5 even if the detected value of the fuel pressure PF is in a relatively low state.

Also, when the engine temperature WT is low at the time of the continuous energization pulse TS being output from the starting time control section 606, the outputting of the continuous energization pulse TS is permitted until the fuel pressure PF becomes relatively high.

As a result, at low temperatures of the engine in which the amount of injection fuel at engine starting becomes relatively large, it is possible to suppress the reduction of the fuel pressure PF from becoming large by means of the injection of fuel.

In addition, after the warming up of the engine in which the amount of injection fuel required at engine starting can be relatively small, or when the engine is started with the fuel pressure PF being relatively high, it is possible to suppress an excessive rise of the fuel pressure PF.

As described above, the high pressure fuel pump control apparatus according to this first embodiment of the present invention includes the rotational position sensor 62 that outputs a predetermined pulse signal in accordance with the rotational position of the internal combustion engine 40, the high pressure fuel pump 20, the accumulator 36 that accumulates the fuel delivered from the high pressure fuel pump 20, the fuel pressure sensor 61 that detects the fuel pressure PF in the accumulator 36, and the ECU 60 (control section) that performs the identification of cylinders of the internal combustion engine 40 based on the predetermined pulse signal, and controls the energization timing of the solenoid 12 based on the detected value of the fuel pressure PF, wherein when the cylinder identification of the internal combustion engine 40 is completed, the energization timing of the solenoid 12 is controlled based on the rotational position of the internal combustion engine 40, whereby the valve closing timing TD of the fuel suction valve 10 is controlled to deliver, from the high pressure fuel pump 20, an amount of fuel necessary to make the detected value of the fuel pressure PF coincide with the target pressure PO, and wherein the ECU 60 includes a starting time control section 606.

The high pressure fuel pump 20 includes the solenoid 12 for opening and closing the fuel suction valve 10 arranged between the fuel suction port and the pressure chamber 23, and serves to pressurize the fuel supplied from the fuel suction port to the pressure chamber 23 through the fuel suction valve 10 and deliver it from the fuel delivery port.

The starting time control section 606 continuously energizes the solenoid 12 over a period of time from the time point at which the internal combustion engine 40 begins to be started until the time point at which the cylinder identification is completed to make it possible to control the valve closing timing of the fuel suction valve 10, as long as a continuous energization inhibition condition (i.e., "NO determination" in any of steps S102 through S106) does not hold.

Thus, in the high pressure fuel pump control apparatus for an internal combustion engine which has the high pressure fuel pump 20 of the engine driven type capable of pressure feeding a controlled amount of fuel by driving the fuel suction valve 10 to close at predetermined timing in a fuel delivery stroke, provision is made for the starting time control section 606 that serves to continuously energize the solenoid 12 of the fuel suction valve 10 over a period from the beginning of engine starting until the time at which it becomes possible to perform the valve closing timing control of the fuel suction valve 10 based on the rotational position of the internal combustion engine 40 as a result of the completion of the cylinder identification, whereby the pressure feeding of the maximum amount of fuel can be performed in a reliable manner from a fuel delivery stroke immediately after the start-up of the internal combustion engine 40 while avoiding the generation of heat due to the energization of the solenoid 12. Accordingly, the combustion state and the exhaust emissions can be prevented from being deteriorated at engine starting by swiftly raising the fuel pressure PF in the accumulator 36.

In addition, when the detected value of the fuel pressure PF exceeds the predetermined determination pressure PFr set beforehand, the starting time control section 606 inhibits the continuous energization of the solenoid 12. At this time, the predetermined determination pressure PFr for determining the inhibition of the continuous energization of the solenoid 12 is set to a value varying in accordance with the detected value of the engine temperature WT.

Moreover, when the duration of the continuous energization of the solenoid 21 exceeds the predetermined maximum time set beforehand, the starting time control section 606 terminates the continuous energization of the solenoid 12, and when the failure of at least one of the rotational position sensor 62 and the fuel pressure sensor 61 is detected, the starting time control section 606 inhibits the continuous energization of the solenoid 12. As a result, excessive continuous energization of the solenoid 12 upon occurrence of an abnormality including a sensor fault can be avoided.

Embodiment 2

Figure 6:
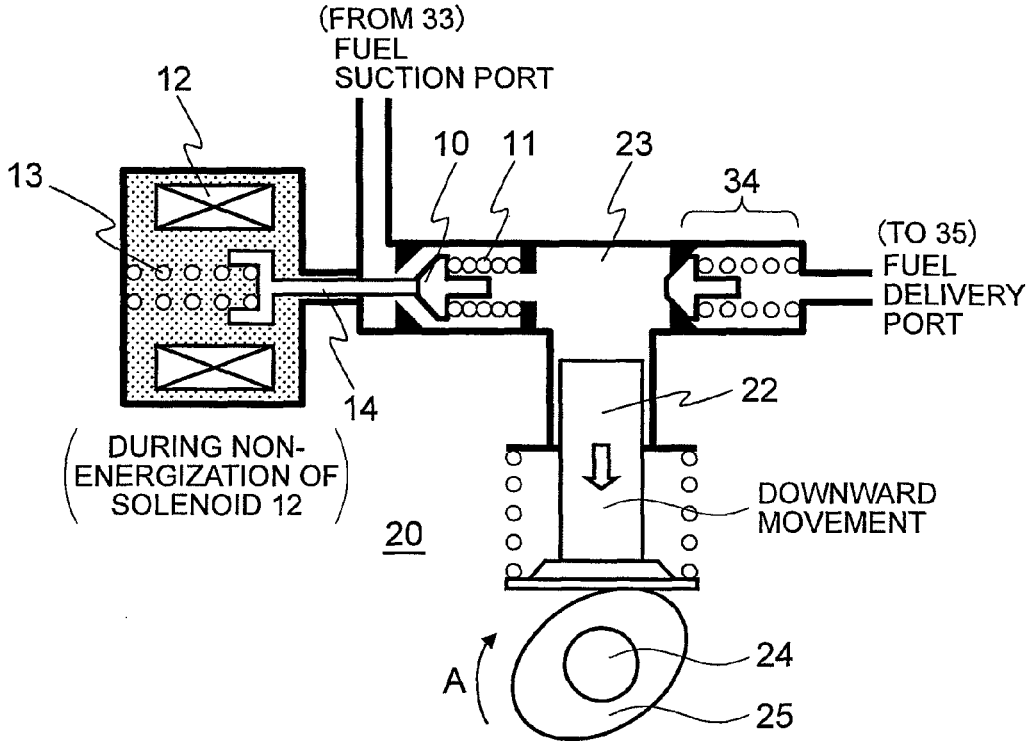
FIG. 6 is a cross sectional view showing a specific configuration of a high pressure fuel pump (at the time of non-energization of a solenoid/fuel suction stroke) according to a second embodiment of the present invention.
Figure 7:
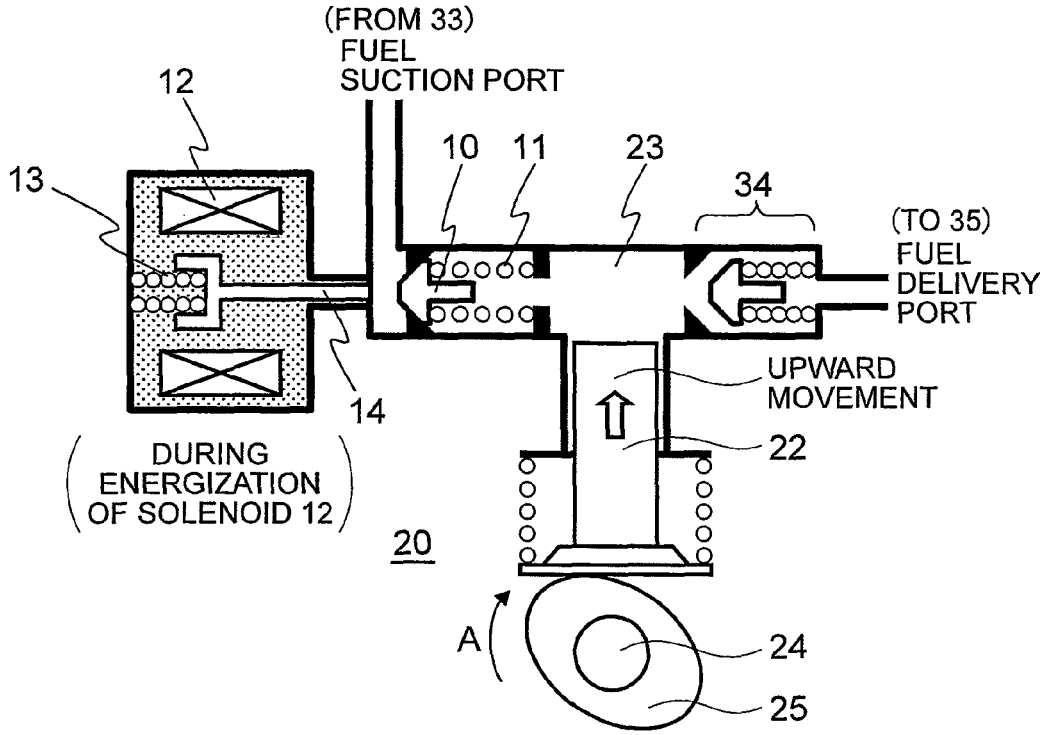
FIG. 7 is a cross sectional view showing a specific configuration of the high pressure fuel pump (at the time of energization of the solenoid/fuel delivery stroke) according to the second embodiment of the present invention.
Figure 8:
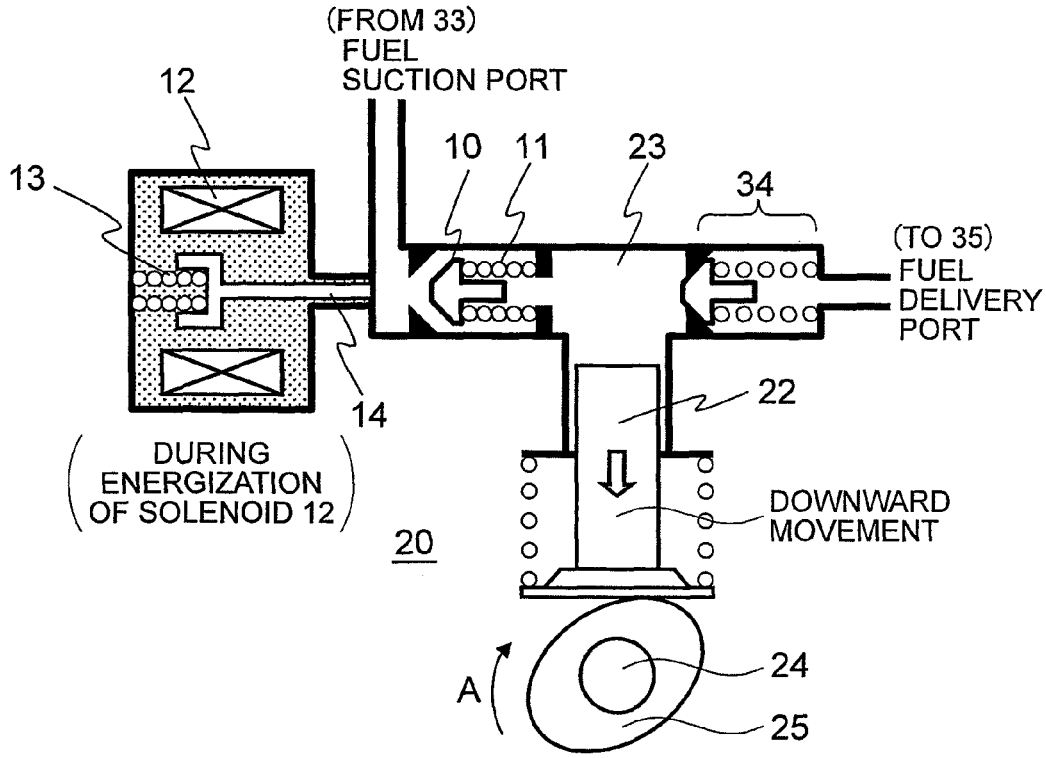
FIG. 8 is a cross sectional view showing a specific configuration of the high pressure fuel pump (at the time of energization of the solenoid/fuel suction stroke) according to a second embodiment of the present invention.

Although in the above-mentioned first embodiment, any concrete configuration of the high pressure fuel pump 20 has not been described, the high pressure fuel pump 20 may be constructed as shown in FIG. 6 through FIG. 8.

FIG. 6 through FIG. 8 are cross sectional views that show a specific configuration of a high pressure fuel pump 20 according to a second embodiment of the present invention. FIG. 6 shows a state where a solenoid 12 is non-energized, and FIGS. 7 and 8 show mutually different operating states where a plunger 22 is driven to move in an upward direction and in a downward direction, respectively, during energization of the solenoid 12.

In the FIG. 6 through FIG. 8, the high pressure fuel pump 20 includes a fuel suction port that is placed in fluid communication with a low pressure passage 33 (see FIG. 1), a fuel delivery port that is placed in fluid communication with a high pressure passage 35 (see FIG. 1), the plunger 22 that is driven to reciprocate in a pressure chamber 23, a fuel suction valve 10 that is arranged between the pressure chamber 22 and the fuel suction port of the high pressure fuel pump 20, a valve closing spring 11 that is arranged in the fuel suction valve 10, a valve opening spring 13 that is arranged in the solenoid 12, a push rod 14 that operates on the same operation axis as that of the fuel suction valve 10, and a fuel delivery valve 34 of a normally closed type that is arranged between the pressure chamber 22 and the fuel delivery port of the high pressure fuel pump 20.

The valve closing spring 11 arranged in the fuel suction valve 10 acts to urge the fuel suction valve 10 in a direction to close from the pressure chamber 23 toward the fuel suction port.

The valve opening spring 13 in the solenoid 12 has an urging force set larger than that of the valve closing spring 11, and contrary to the valve closing spring 11, it acts to urge the fuel suction valve 10 in a direction to open from the fuel suction port toward the pressure chamber 23.

The push rod 14 is arranged between the fuel suction valve 10 and the valve opening spring 13, and operates to be placed in pressure contact with the fuel suction valve 10 under the action of the urging force of the valve opening spring 13 during non-energization of the solenoid 12. In addition, during energization of the solenoid 12, the push rod 14 acts in a direction against the urging force of the valve opening spring 13, and operates to move away from the fuel suction valve 10 under the action of an electromagnetic force that is larger than the urging force of the valve opening spring 13.

The normally closed type fuel delivery valve 34 (check valve) has a construction to permit only the passage of fuel from the pressure chamber 23 toward the fuel delivery port, as previously stated.

First, in FIG. 6, there is shown that the solenoid 12 is in a non-energized state and the high pressure fuel pump 20 is on the fuel suction stroke (i.e., the plunger 22 is in a state to move downward in a direction indicated by a thick arrow). In this case, the solenoid 12 is in the non-energized state, so the push rod 14 is pushed to the right side in FIG. 6 by means of the urging force of the valve opening spring 13, whereby it is placed in pressure contact with the fuel suction valve 10, as a result of which the fuel suction port and the pressure chamber 23 become in fluid communication with each other.

When the camshaft 24, being in the state of FIG. 6, is driven to rotate in the direction of arrow A, the displacement of the pump cam 25 is reduced to drive the plunger 22 to move downward, as shown by the thick arrow, so fuel is sucked from the fuel suction port into the pressure chamber 23. As shown in FIG. 6, in the fuel suction stroke, the solenoid 12 is usually non-energized to maintain the fuel suction valve 10 at its valve opened state, so that upon downward movement of the plunger 22, fuel can be sucked from the fuel suction port into the pressure chamber 22.

On the other hand, in FIG. 7, there is shown that the solenoid 12 is in an energized state and the high pressure fuel pump 20 is on the fuel delivery stroke (i.e., the plunger 22 is in a state to move upward in a direction indicated by a thick arrow).

In this case, the solenoid 12 is in the course of being energized, so the push rod 14 is pulled to the left in FIG. 7 by means of an electromagnetic force generated in a direction opposite to the urging force of the valve opening spring 13, and is away from the fuel suction valve 10. As a result, the fuel suction valve 10 is pushed to the left in FIG. 7 to be closed by the urging force of the valve closing spring 11, whereby the fuel suction port and the pressure chamber 23 are placed in a state isolated from each other.

When the camshaft 24, being in the state of FIG. 7, is driven to rotate in the direction of arrow A, the displacement of the pump cam 25 is increased to drive the plunger 22 to move upward as shown by the thick arrow, so the fuel sucked in the pressure chamber 23 is pressurized to cause the fuel delivery valve 34 to open, whereby it is pressure fed from the fuel delivery port to the high pressure passage 35.

As shown in FIG. 7, in the fuel delivery stroke, the solenoid 12 is usually energized at predetermined timing during the period of the fuel delivery stroke to close the fuel suction valve 10, whereby when the plunger 22 is driven to move upward after the closing of the fuel suction valve 10, the fuel in the pressure chamber 22 can be pressure fed from the fuel delivery port.

Here, giving a supplementary explanation, in the fuel delivery stroke, if the fuel suction valve 10 is closed in the top or first position of the fuel delivery stroke period, a maximum amount of fuel can be pressure fed, and the amount of fuel to be pressure fed can be decreased in accordance with the valve closing timing of the fuel suction valve 10 retarded from the top or first position of the fuel delivery stroke period. Thus, it is possible to adjust the amount of fuel to be pressure fed by controlling the valve closing timing of the fuel suction valve 10 to a predetermined timing in the fuel delivery stroke period.

In addition, in FIG. 8, there is shown that the solenoid 12 is in an energized state and the high pressure fuel pump 20 is on the fuel suction stroke (i.e., the plunger 22 is in a state to move downward in a direction indicated by a thick arrow). In this case, the solenoid 12 is in the course of being energized, so similar to FIG. 7, the push rod 14 is pulled to the left in FIG. 8 by means of an electromagnetic force generated in a direction opposite to the urging force of the valve opening spring 13, and is away from the fuel suction valve 10.

However, in case of FIG. 8, the high pressure fuel pump 20 is on the fuel suction stroke, so unlike the case of FIG. 7, the fuel suction valve 10 is not closed by being pushed to the left in FIG. 8 by the urging force of the valve closing spring 11, and hence the fuel suction port and the pressure chamber 23 are not placed in a state isolated from each other.

This is due to the following reason. That is, since the high pressure fuel pump 20 is on the fuel suction stroke, the sum of a fuel pressure (acting to urge the fuel suction valve 10 in a valve opening direction), which acts to the right in FIG. 8 due to the delivery pressure of the low pressure fuel pump 31 (see FIG. 1) upstream of the low pressure passage 33, and a force (acting to urge the fuel suction valve 10 in a valve opening direction), which acts to the right in FIG. 8 due to a negative pressure that is generated in the pressure chamber 23 by the downward movement of the plunger 22 caused by reduction in the displacement of the pump cam 25 due to the rotation of the cam shaft 24 in a direction of arrow A, overcomes the valve-closing urging force of the valve closing spring 11.

As a result, in the fuel suction stroke, even if the solenoid 12 is energized, the fuel suction valve 10 is kept in its opened state to place the fuel suction port and the pressure chamber 23 in fluid communication with each other, as shown in FIG. 8.

When the camshaft 24, being in the state of FIG. 8, is driven to rotate in the direction of arrow A thereby to reduce the displacement of the pump cam 25 to move the plunger 22 in a downward direction, fuel is sucked from the fuel suction port into the pressure chamber 23, as in the case of FIG. 6.

In addition, when the high pressure fuel pump 20 shifts from the fuel suction stroke (see FIG. 8) to the fuel delivery stroke (see FIG. 7) with the solenoid 12 remaining energized, the high pressure fuel pump 20 operates in the same manner as described in FIG. 7 from the top or first position of the fuel delivery stroke, so the maximum amount of fuel is pressure fed from the pressure chamber 23.

According to this second embodiment of the present invention, by using the mechanism characteristic of the high pressure fuel pump 20 as described above, the solenoid 12 is continuously energized at the time of engine starting, so that the pressure feeding of a maximum amount of fuel can be achieved.

Now, specific reference will be made to the energization current of the solenoid 12 (i.e., the current to be supplied to the solenoid 12) according to the second embodiment of the present invention while referring to a timing chart in FIG. 9.

Figure 9:
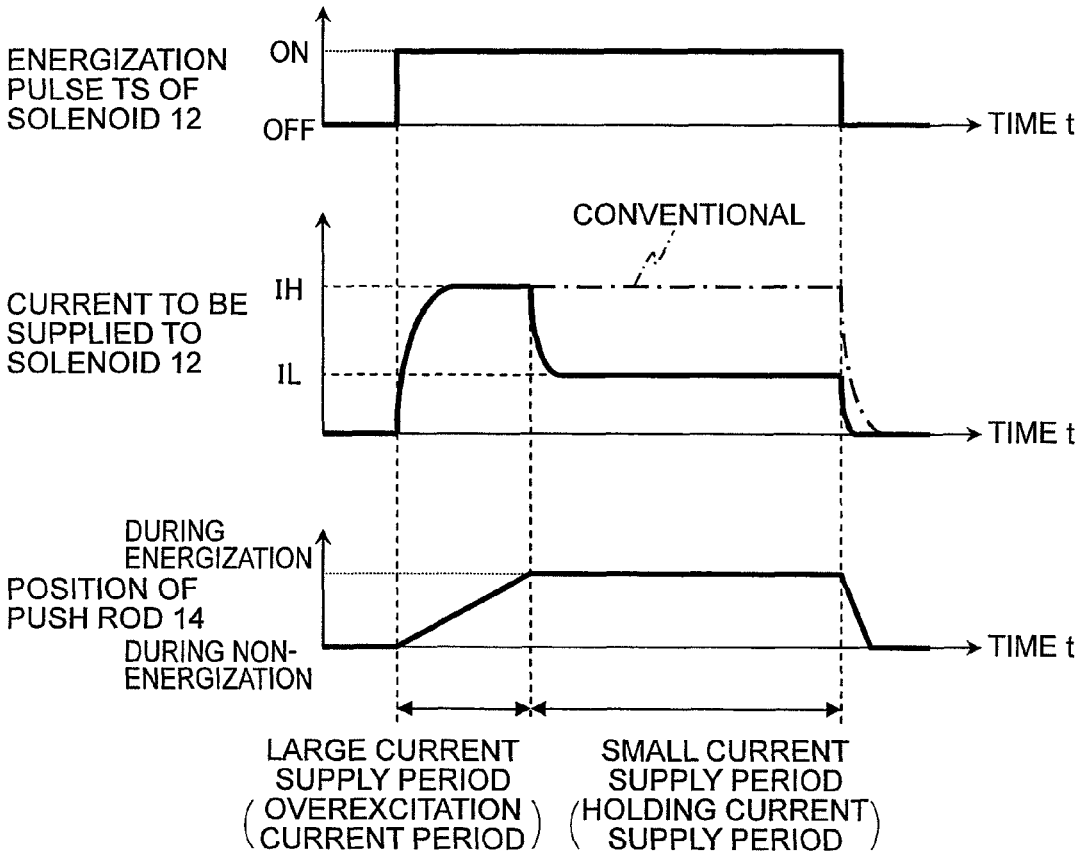
FIG. 9 is a timing chart illustrating a control operation for energization current of the solenoid according to the second embodiment of the present invention.

In FIG. 9, the axis of abscissa represents the elapse of time t, and the axis of ordinate represents, sequentially from top to bottom, individual control states of the continuous energization pulse TS (on/off) of the solenoid 12, the waveform of the current to be supplied to the solenoid 12, and the operating position of the push rod 14 (at the time of energization/non-energization of the solenoid 12).

Here, note that in the waveform of the current to be supplied to the solenoid 12 (also referred to as the energization current), a predetermined large current IH corresponds to an overexcitation current, and a predetermined small current IL corresponds to a holding current. In addition, the waveform of an energization current according to the aforementioned conventional apparatus is indicated by an alternate long and short dash line, and the waveform of the energization current according to the second embodiment of the present invention is indicated by a solid line.

In FIG. 9, according to the waveform of the energization current (the alternate long and short dash line) of the conventional apparatus, a large current IH necessary to operate the push rod 14 with a high degree of response is supplied to the solenoid 12 at the same time as when the energization pulse TS of the solenoid 12 is turned on from off. As a result, the push rod 14 is moved from a "non-energized" position to an "energized" position by the excitation of the solenoid 12, and is maintained at its energized operating position over a period until the energization pulse TS of the solenoid 12 is turned off.

In this manner, with the waveform of the energization current according to the conventional apparatus (the alternate long and short dash line), the large current IH necessary to operate the push rod 14 is supplied to the solenoid 12 is supplied during a period in which the energization pulse TS of the solenoid 12 is on, so in case where the on period is prolonged, there occurs a possibility that excessive generation of heat in the solenoid 12 becomes aggravated, thus impairing reliability, as described in the above-mentioned problems. As a result, the on period of the energization pulse TS can not be set to a long time.

In contrast to this, with the waveform of the energization current according to the second embodiment of the present invention (the solid line), in a predetermined period from the time point at which the energization pulse TS of the solenoid 12 is turned on from off to the time point at which the push rod 14 is moved from its position of the "non-energization of the solenoid" to its position of the "energization of the solenoid" (a large current supply period or an overexcitation current supply period), the large current IH necessary to operate the push rod 14 with high response is supplied Thereafter, in a period from the termination of the large current supply period to the termination of energization at which the energization pulse TS is turned off again (a small current supply period or a holding current supply period), the energization current is controlled to be changed over so as to supply the small current IL necessary to maintain the push rod 14 at its "solenoid-energized" operating position.

As described above, the high pressure fuel pump 20 according to the second embodiment of the present invention includes the plunger 22 that is driven to reciprocate in the pressure chamber 23 in synchronization with the rotation of the internal combustion engine 40, the valve closing spring 11 that acts to urge the fuel suction valve 10 in a direction to close from the pressure chamber 23 toward the fuel suction port, the valve opening spring 13 that acts to urge the fuel suction valve 10 in a direction to open from the fuel suction port toward the pressure chamber 23 in opposition to the valve closing spring 11 and has an urging force set larger than that of the valve closing spring 11, the push rod 14 that is arranged between the fuel suction valve 10 and the valve opening spring 13 in such a manner that it operates to be placed in pressure contact with the fuel suction valve 10 under the action of the urging force of the valve opening spring 13 during non-energization of the solenoid 12, and acts in a direction against the urging force of the valve opening spring 13 so as to move away from the fuel suction valve 10 under the action of the electromagnetic force that is larger than the urging force of the valve opening spring 13 during energization of the solenoid 12, and the fuel delivery valve 34 of the normally closed type that is arranged between the pressure chamber 23 and the fuel delivery port so as to make it possible for fuel to pass only from the pressure chamber 23 to the fuel delivery port.

The starting time control section 606 supplies a predetermined large current IH to the solenoid 12 in an initial period of the start of energization from the beginning of the continuous energization of the solenoid 12 until the push rod 14 is moved from a first operating position thereof during non-energization of the solenoid 12 to a second operating position thereof during energization of the solenoid 12.

Also, in a period after the initial period of the start of energization until the termination of energization, the starting time control section 606 changes over the energization current so as to supply the small current IL necessary to maintain the push rod 14 at its operating position during the energization of the solenoid 12.

As a result, the amount of current to be supplied to the solenoid 12 as a whole can be reduced to a substantial extent, and a concern of heat generation of the solenoid 12 can be eliminated in a reliable manner, thereby making it possible to increase the on period of the solenoid 12. Accordingly, the solenoid 12 can continuously be energized in a more reliable manner at the time of starting of the internal combustion engine 40 .

While the invention has been described in terms of preferred embodiments, those skilled in the art will recognize that the invention can be practiced with modifications within the spirit and scope of the appended claims.

What is claimed is:

1. A high pressure fuel pump control apparatus for an internal combustion engine, comprising:

a rotational position sensor that outputs a predetermined pulse signal in accordance with the rotational position of an internal combustion engine;

a high pressure fuel pump that has a solenoid for opening and closing a fuel suction valve arranged between a fuel suction port and a pressure chamber, and serves to pressurize fuel supplied from said fuel suction port to said pressure chamber through said fuel suction valve and deliver it from a fuel delivery port;

an accumulator that accumulates the fuel delivered from said high pressure fuel pump;

a fuel pressure sensor that detects the pressure of fuel in said accumulator; and a control section that performs identification of cylinders of said internal combustion engine based on said predetermined pulse signal, and controls the energization timing of said solenoid based on a detected value of said fuel pressure;

wherein when the cylinder identification of said internal combustion engine is completed, said control section controls the energization timing of said solenoid based on the rotational position of said internal combustion engine, whereby valve closing timing of said fuel suction valve is controlled to deliver, from said high pressure fuel pump, an amount of fuel necessary to make the detected value of said fuel pressure coincide with a target pressure; and said control section includes a starting time control section for continuously energizing said solenoid over a period of time from a time point at which said internal combustion engine begins to be started until a time point at which said cylinder identification is completed to make it possible to control the valve closing timing of said fuel suction valve.

2. The high pressure fuel pump control apparatus for an internal combustion engine as set forth in claim 1, wherein when the detected value of said fuel pressure exceeds a predetermined determination pressure set beforehand, said starting time control section inhibits the continuous energization of said solenoid.

3. The high pressure fuel pump control apparatus for an engine as set forth in claim 2, further comprising:

an engine temperature sensor that detects an engine temperature of said internal combustion engine;

wherein said predetermined determination pressure for determining inhibition of the continuous energization of said solenoid is set to a value varying in accordance with a detected value of said engine temperature.

4. The high pressure fuel pump control apparatus for an internal combustion engine as set forth in any one of claim 1, wherein when a duration of the continuous energization of said solenoid exceeds a predetermined maximum time set beforehand, said starting time control section terminates the continuous energization of said solenoid.

5. The high pressure fuel pump control apparatus for an internal combustion engine as set forth in any one of claim 1, wherein when a failure of at least one of said rotational position sensor and said fuel pressure sensor is detected, said starting time control section inhibits the continuous energization of said solenoid.

6. The high pressure fuel pump control apparatus for an internal combustion engine as set forth in any one of claim 1, wherein said high pressure fuel pump includes:

a plunger that reciprocates in said pressure chamber in synchronization with the rotation of said internal combustion engine;

a valve closing spring that acts to urge said fuel suction valve in a direction to close from said pressure chamber toward said fuel suction port;

a valve opening spring that acts to urge said fuel suction valve in a direction to open from said fuel suction port toward said pressure chamber in opposition to said valve closing spring and has an urging force set larger than that of said valve closing spring;

a push rod that is arranged between said fuel suction valve and said valve opening spring in such a manner that it operates to be placed in pressure contact with said fuel suction valve under the action of the urging force of said valve opening spring during non-energization of said solenoid, and acts in a direction against the urging force of said valve opening spring so as to move away from said fuel suction valve under the action of an electromagnetic force that is larger than the urging force of said valve opening spring during energization of said solenoid; and a fuel delivery valve of a normally closed type that is arranged between said pressure chamber and said fuel delivery port so as to make it possible for fuel to pass only from said pressure chamber toward said fuel delivery port;

wherein said starting time control section supplies a predetermined large current to said solenoid in an initial period of the start of energization from the beginning of the continuous energization of said solenoid until said push rod is moved from its solenoid-nonenergized operating position to its solenoid-energized operating position; and said starting time control section changes over energization current so as to supply a small current necessary to maintain said push rod at its solenoid-energized operating position in a period after said initial period of the start of energization until the termination of energization.

* * * * *